United States Patent [19]

McCallister

[11] Patent Number: 4,550,914

[45] Date of Patent: Nov. 5, 1985

[54] GOLF CLUB HEAD WITH VISUAL SWING-DIRECTING CUES

[76] Inventor: John McCallister, 3941 Fairbreeze Cir., Westlake Village, Calif. 91361

[21] Appl. No.: 648,762

[22] Filed: Sep. 6, 1984

[51] Int. Cl.[4] ..... A63B 69/36

[52] U.S. Cl. ..... 273/183 D; 273/77 A; 273/164

[58] Field of Search ..... 273/164, 183 D, 163 R, 273/163 A, 186 A; D21/220, 214, 219

[56] References Cited

U.S. PATENT DOCUMENTS

| | | | |
|---|---|---|---|
| D. 96,478 | 8/1935 | Jansky | 273/164 X |
| D. 156,963 | 1/1950 | Johnson | 273/164 X |
| D. 204,466 | 4/1966 | Sowers | 273/164 X |
| D. 218,108 | 7/1970 | Wegener | 273/164 |
| D. 243,706 | 3/1977 | Hall | D21/220 |
| D. 261,167 | 10/1981 | Swanson | D21/220 |
| 1,441,492 | 1/1923 | Dwight | 273/164 |
| 1,569,212 | 1/1926 | Aitken | 273/175 |
| 1,927,083 | 9/1933 | Davis | 273/164 |
| 2,005,401 | 6/1935 | Storz | D21/220 |
| 2,447,967 | 8/1948 | Stone | 273/164 |
| 2,520,950 | 9/1950 | Miller | 273/164 |
| 3,088,736 | 5/1963 | Mospan | 273/164 X |
| 3,722,887 | 3/1973 | Cochran et al. | 273/164 |
| 4,077,632 | 3/1978 | Taylor | 273/164 |
| 4,128,244 | 12/1978 | Duclos | 273/164 |
| 4,345,763 | 8/1982 | Swanson | 273/164 |

*Primary Examiner*—George J. Marlo

*Attorney, Agent, or Firm*—Poms, Smith, Lande & Rose

[57] ABSTRACT

A golf club head adapted to provide a visual cue to a golfer which promotes an inside-outside forward swing of the club head. The club head includes three parallel, visual cue lines, which are provided by the outer edge of the club head toe and the two edges of the face lines. All three cue lines are slanted toward the golfer to provide a visual cue which promotes an outside-inside backswing, which results in a desired inside-outside front swing.

12 Claims, 5 Drawing Figures

Fig. 1.
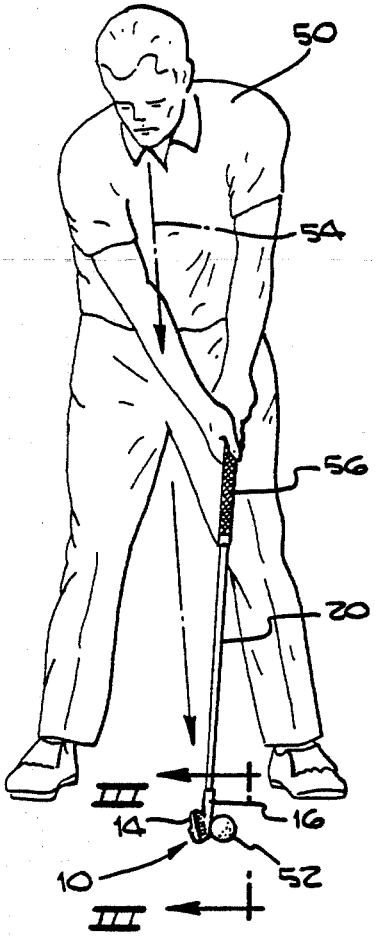
Fig. 2.
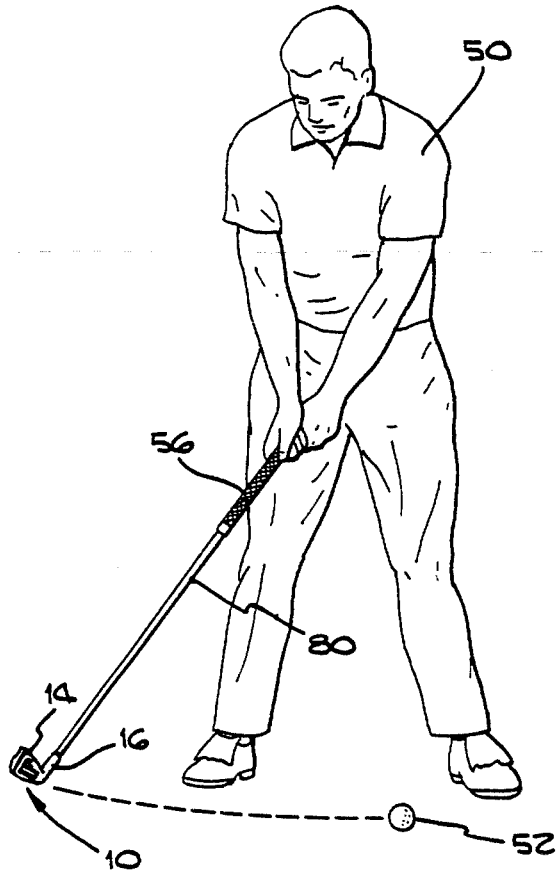
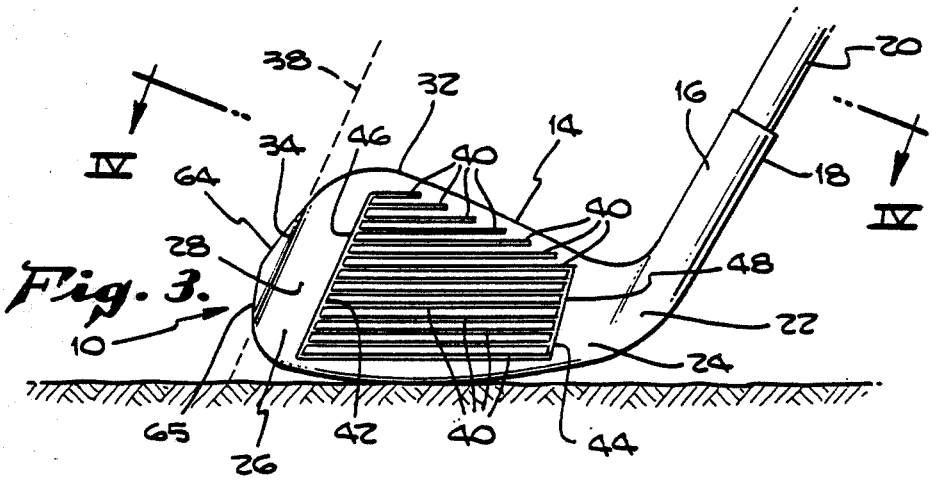
Fig. 3.

A
B
C
10
16
20
30
32
33
34
46
48
58
60
62
64
65
67
69
70
72
74
76
78
80
82
84
86
88

GOLF CLUB HEAD WITH VISUAL SWING-DIRECTING CUES

BACKGROUND OF THE INVENTION

The present invention relates generally to golf club heads which include visual indicators or cues designed to promote desirable golf swing characteristics. More particularly, the present invention relates to a golf club head having visual cues which promote an outside-inside backswing and an inside-outside front swing.

As is well known, golf clubs are generally of two types: the "wood" or distance clubs, and the "irons." Both types of clubs basically include a shaft having a grip portion on one hand with a club head attached to the other end. A complete set of "iron" golf clubs typically includes nine clubs numbered 1–9. Additionally, the complete "iron" golf club set will include a sand wedge, a pitching wedge, and may include various other specialty clubs.

The head of conventional "iron" clubs is typically made from steel or steel alloys such as stainless steel which may or may not be chrome plated. The head may be cast, forged or machined, to provide a blade portion which is integral with a hosel or neck portion. A blade portion is used in striking the golf ball with the hosel portion being designed to connect the blade to the club shaft. As is well known, the numbered clubs, 1–9, have different shaft lengths and differing blade weights and blade loft angles to allow a golfer to hit a golf ball different distances using approximately the same golf swing.

The ultimate goal of the golf swing, regardless of the type of club being used, is to hit the golf ball in a desired, pre-selected direction or line of flight. In general the golfer positions himself so that his shoulders and feet are substantially parallel to the desired line of flight of the golf ball. A complete golf swing basically includes the backswing, the forward swing, and the follow through. An important feature of the golf swing is the angle at which the golf club head travels relative to the intended line of flight during both the backswing and frontswing. In general, it has been found that the club head, during the backswing, should be moved towards the golfer at an inward angle away from the intended line of flight of the golf ball. On the forward swing, the golf club head preferably moves forward along the same club head path defined during the backswing. The inward movement of the golf club during the backswing is commonly referred to as an outside-inside backswing, with the forward movement of the club head along the same path during the forward swing being commonly referred to as an inside-outside swing. This type of overall golf swing is commonly referred to simply as an inside-outside swing. Many golfers have found that the use of an inside-outside swing provides a desired impact configuration between the club head face and the golf ball which results in travel of the golf ball along the desired line of flight.

The inside-outside swing is to be contrasted with the outside-inside swing in which the club head is moved away from the golfer during the backswing at an outward angle relative to the intended line of flight and subsequently moved from an outside to an inside position during the forward swing. The outside-inside swing typically results in the face of the club head moving laterally relative to the intended line of flight during ball impact. Such lateral movement of the club head imparts a side spin to the ball resulting in an undesirable curved flight path for the ball which is commonly referred to as a "slice."

Many beginning golfers tend to swing their club heads in the undesirable outside-inside manner. The natural tendency for right handed golfers during the forward portion of the golf swing is to attempt to hit the golf ball to the left side of the intended line of flight by moving the golf club head from an outside position at the end of the backswing to an inside position relative the golfer and the intended line of flight at the point of ball impact. As mentioned above, this type of swing results in a curve or slice of the golf ball to the right side of the intended line of flight. For inexperienced golfers, there is a natural tendency to increase the outside-inside nature of their golf swing in order to correct the slice. This natural tendency to increase the outside-inside character of the golf swing results in the slice becoming increasingly worse.

In order to overcome the natural tendency of many golfers to utilize an improper outside-inside swing, it would be desirable to provide a golf club head which provides visual cues or indicators which promote or otherwise tend to make the golfer utilize an inside-outside golf swing.

SUMMARY OF THE INVENTION

In accordance with the present invention, an improved golf club head is provided which includes at least three visual cues which promote an inside-outside swing. The visual cues provide a complementary indicator system which provides a visual means for promoting an outside to inside backswing which in turn promotes the desired inside-outside forward swing.

The present invention is based upon a golf club head having a club head body with a heel portion, a toe portion, a front face, a bottom and a top head. As a particular feature of the present invention, the toe portion includes an outer edge which slants towards the golfer when the club head bottom is positioned on the playing surface. The degree of slant (angle of the outer edge relative to vertical) of the toe portion outer edge is such that the outer edge, when viewed by the golfer, is parallel with the desired outside-to-inside backswing angle which is necessary to promote the desired inside-outside forward swing.

The present invention further includes a plurality of spaced horizontal face lines on the club head face which are visible to the golfer and which are substantially horizontal when the club head body is positioned on the playing surface. Each of the face lines includes a toe ehd and a heel end. The length and positioning of the face lines are provided in accordance with the present invention so that the edge of the face lines near the toe edge define a face line toe edge which is substantially parallel to the outer edge of said toe portion. Further, the lengths and positioning of the face lines are such that a face line heel edge is provided near the club head heel which also is substantially parallel to the outer edge of the toe portion. The outer edge of the toe portion in combination with the face line toe edge and face line heel edge provide a non-contradictory system of complementary visual cue lines which, when viewed by the golfer as he addresses the ball, promote an inside-outside golf swing.

As an additional feature of the present invention, slanted cue lines extending along the face line toe edge and the face line heel edge are provided to further enhance the combined visual cues provided to the golfer. As a further feature, the back surface of iron club heads in accordance with the present invention are designed so that only the top edge of the club head blade and not the back surface is visible to the golfer as he addresses the ball. This reduces any visual distractions which may tend to lessen the effect of the visual cues provided by the toe portion outer edge and face line edges.

As another feature of the present invention, the bottom toe edge line is exposed to the golfer's view when the golfer addresses the golf ball. The exposed toe edge line positioned so that it appears to be at a right angle relative to the lower leading edge of the club head when viewed by the golfer as he addresses the golf ball. The toe edge line provides a visual cue line which is parallel to the line of flight of the ball and therefore is useful in lining up the club head relative the ball. As a further feature, the top edge of the club head blade narrows from the toe of the blade to the hosel. The narrowing of the club head top edge de-emphasizes the top line of the club head so that the golfer can concentrate on the visual cue lines on the club head face. The narrowing of the top edge also presents a visual illusion to the golfer that makes the club face look like it has more loft than it actually has. This feature is useful for lower lofted clubs since the golfer perceives that he is swinging a higher lofted club and as is well known, most golfers find it easier to swing higher lofted clubs than lower lofted clubs.

The club head, in accordance with the present invention, is an improvement over prior club head designs in which the various toe shapes and face line configurations present contradictory visual cue lines to the golfer. The present invention provides a club head in which the three most important visual cue lines, i.e., the toe portion outer edge, are all slanted at substantially the same angle to provide non-contradictory visual cues which point in the direction of the desired backswing arc.

The above-discussed and many other features and attendant advantages of the present invention will become apparent as the invention becomes better understood by reference to the following detailed description when considered in conjunction with the accompanying drawings.

BRIEF DESCRIPTION OF THE DRAWINGS

FIG. 1 is a view of a golfer as he addresses a golf ball utilizing a golf club including an exemplary preferred club head in accordance with the present invention. The view is perpendicular to the desired line of flight of the golf ball.

FIG. 2 is the same as FIG. 1 except that the golfer is shown at a given position during the backswing.

FIG. 3 is a view of FIG. 1 taken in the III—III plane. The III—III plane is parallel to the intended line of flight of the golf ball.

DETAILED DESCRIPTION OF THE INVENTION

Figures 4, 5:
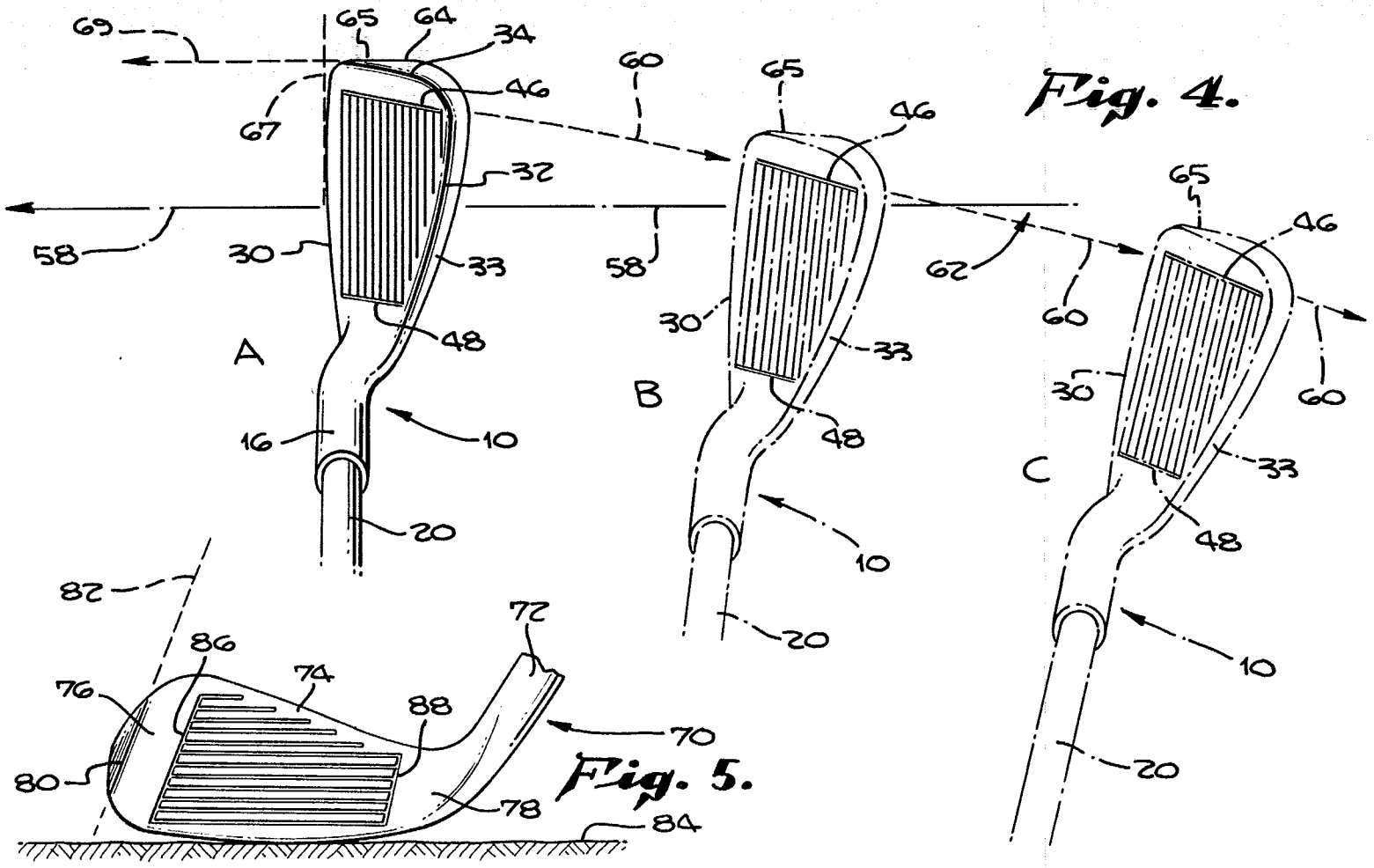
FIG. 4 is a sequential view of FIG. 3 taken in the IV—IV plane to show the travel of the preferred exemplary golf club head during the backswing and forward swing.
FIG. 5 is a front view of a second exemplary preferred club head in accordance with the present invention.

A preferred exemplary golf club head in accordance with the present invention is shown generally at 10 in FIGS. 1–4. The club head is an "iron" type club head which has the weight, loft angle and size of a no. 8 iron. Another exemplary club in accordance with the present invention corresponding to an no. 2 iron is shown generally at 70 in FIG. 5. Although the following description will be limited to the above two iron clubs, it should be understood that the present invention has application to the other "iron" club heads and also to the "wood" type club heads.

The club head 10 includes a club head body 14 and an integral hosel 16. The club head 10 can be made from any of the conventional materials, such as stainless steel and steel alloys which are commonly used in making iron club heads. The hosel 16 includes a shaft portion 18 which is designed to receive the golf club shaft 20. The means of connecting the shaft 20 to the hosel shaft portion 18 can be any conventional configuration commonly employed in golf club construction. In general, the hosel shaft, portion 18 will include a bore into which shaft 20 is inserted and secured. The hosel 16 further includes a club body portion 22 which is integrally connected to the club head body 14.

As best shown in FIG. 3, the club head body 14 includes a heel portion 24, a toe portion 26, a front face 28, a bottom 30, and a top edge 32. The toe portion 26 includes an outer edge 34. The outer edge 34 is slanted toward the golfer when the club head body bottom 30 is positioned on the playing surface, 36. Preferably, the outer edge 34 is slanted so that the angle between the outer edge (as represented by dotted lines 38) and the playing surface 34 is between about 60 degrees and 80 degrees. More preferably, the angle should be between about 60 degrees and 70 degrees. For an 8-iron, such as club head 10, it is preferred that the angle between outer edge 34 and playing surface 36 be approximately 65 degrees. For the purposes of this specification, the playing surface will be deemed to be a flat, horizontal plane.

The front face 28 of the club head includes a plurality of spaced horizontal face lines 40. Face lines, in general, are a well-known feature of iron clubs. The face line may be grooves formed within the front face or they may be raised surfaces protruding outward from the front face. Face lines are generally provided on iron club faces in order to impart backspin to the golf ball. Backspin is desirable to limit ground roll of the ball. Such ground roll is many times undesirable when hitting onto a green. Although protruding face lines can be used, it is preferred that the face lines 40, be grooves in the front face 28, which may or may not be painted in a contrasting color. The depth and width of the face line grooves 40 may be varied within the limits commonly employed in connection with various types of clubs. The actual width and depth of the face line grooves 40, along with the color of the grooves, is not particularly important, so long as the face lines 40 are clearly visible to the golfer during positioning of the golf club and the initial stages of the backswing.

As can be seen from FIG. 3, the length of the face lines 40 is varied in order to accommodate the particular shape of the club head top edge 32. Further, the length of face lines 40 is chosen such that the toe end of the face lines provides a face line toe edge 42 which is substantially parallel to outer edge 34. It is not critical that the face line toe edge 42 be exactly parallel with outer edge 34; it is only important that the face line toe edge 42 be substantially parallel so that the outer edge 34 and face line toe edge 42 appear to be lined up in the same direction when viewed by the golfer when the club is in the set position as shown in FIG. 1.

The heel end of face lines 40 further define a face line heel edge 44 which is substantially parallel to both the outer edge 34 and face line toe edge 42. Again, it is not important that the face line heel edge 44 be exactly parallel with outer edge 34 and face line toe edge 42; it is only important that the face line heel edge 44 is slanted at substantially the same degree as lines 34 and 42 so that the golfer is provided with three non-contradictory visual cue lines 34, 42, and 44 when he uses the golf club as shown in FIGS. 1 and 2.

Although it is not necessary, it is preferred that the face line edges 42 and 44 include slanted cue lines 46 and 48 which extend along the face line toe edge and heel edge, respecitvely. The two cue lines 42 and 44 are preferred since they provide visual enhancement of the face line edges to increase the degree of visual prompting or "cue" provided by the club head 10.

In FIG. 1, a golfer 50 is shown in a conventional golfing stance just prior to initiating the backswing. The line of sight from the golfer's eye to the club head 10 and the golf ball 52 is represented by line 54. The golf club shaft 20 includes grip 56 to allow conventional gripping of the club for positioning and swinging thereof.

The view of club head 10 along the golfer's line of sight 54 is shown in FIG. 4. In position A, the club head 10 is in the position shown in FIG. 1 (golf ball 52 not shown). The intended line of flight of the golf ball is represented by line 58. Positions B and C shown in FIG. 4 represent the position of the club at different stages of the backswing. Postiion C is the golfer's view of the club along the line of sight 54 when the club head is in the position shown in FIG. 2.

As previously mentioned, it is desirable that the club head move at an angle relative to the line of flight of the ball 58 so that the club head moves towards the golfer during the backswing. The direction of club head 10 movement in FIG. 4 is represented by phantom lines 60. The phantom lines 60 define the desired swing path of the golf club head 10 during both the backswing and the forward swing (i.e. outside-inside backswing and inside-outside frontswing). In general, the path 60 along which the golf club head travels during the backswing will be the same path along which the club head 10 travels during the foward swing. Since the visual cues in accordance with the present invention are usually not visible to the golfer during a normal forward swing due to the velocity of the club head and the golfer's restricted field of vision towards the golf ball, the visual cue lines 34, 46 and 48 are intended to provide visual cues for the direction of the backswing only with it being intended that the promotion of a backswing as represented in FIG. 4 will in turn promote a forward swing movement in a desired inside-outside manner along line 60.

As can be seen from FIG. 4, the club head 10 moves from position A, which is directly in line with the intended golf ball flight line 58, inwardly to positions B and C which are closer to the golfer. The relative angle between the club travel path 60 during the backswing and the intended ball flight line 58 may be different for golfers of different heights who may be using different length club shafts and whose line of sight 54 to the club head 10 may be at a different angle. In general, it is preferred that the interior angle between the club head swing line 60 and the ball flight line 58 be from five to twenty degrees (see arrow 62). As can be seen in FIG. 4, the cue lines 34, 46 and 48 appear to be parallel with the desired club head travel path 60. The three cue lines 34, 46 and 48 provide a visual cue when viewed by the golfer which results in a natural reaction by the golfer which promotes movement of the club head along path 60 during the backswing. During the forward swing, the club head moves forward along the same path 60 to position A for impact with the golf ball. The outside-inside backswing shown in FIG. 4, as previously mentioned, promotes in a forward swing that moves along line 60 from inside to outside as desired to prevent undesirable slicing of the ball.

Preferably, the club head 10 includes a back face which is sloped inwardly sufficiently so that only the top edge 32 of the club is visible to the golfer as best shown in FIG. 4. By ensuring that only top edge 32 is visible, the visual cueing effect provided by lines 34, 46 and 48 is not lessened by the presence of a visible rear surface. Top edge 32 should be as thin as possible to reduce any distracting visual lines which may take away from the visual cues provided by lines 34, 46 and 48. Of course, the edge 32 should be thick enough to provide the necessary structural strength to the club head.

The club head 10 is also preferably designed so that the rear outer edge 64 of the club head is also visible to the golfer when positioning the club as again best shown in FIG. 4. The edge 64 provides an additional enhancement or reinforcement of the three main visual cue lines 34, 46 and 48 to further promote the desired backswing as shown in FIG. 4. The club head 10 is preferably designed so that the bottom toe edge line 65 is visible to the golfer when he addresses the ball as best shown in FIG. 4. The toe edge line 65 should appear to be at a right angle to the club head leading edge or bottom 30 when viewed by the golfer as indicated by dotted lines 67 and 69. The line 69 is parallel to the intended line of flight of the ball 58. This particular feature provides a visual cue which allows the golfer to line up the club head correctly when he addresses the ball. This particular configuration of the toe edge 65 is preferred since it provides a means to initially line up the club head and ball prior to initiating the swing. The use of the toe edge 65 as a means for allowing the golfer to initially line up the club head and ball is preferred since it provides a desireable visual cue which promotes proper initial alignment of the club head without interfering with the visual cue provided by the system of lines 34, 46 and 48 as previously described.

As best shown in FIG. 4, it is preferred that the width of top edge 32 decrease from the club head toe end towards the hosel 16. This narrowing de-emphasizes the edge or top line 32 seen by the golfer so that the golfer will concentrate more on the visual cue lines 34, 46 and 48. The narrowing of the top edge 32 as you move along the edge 32 towards the hosel 16 also gives the club head face 28 the illusion of having more loft than it actually has. As the front line 33 of the top edge 32 narrows towards the hosel, it appears to move away from the leading edge 30 of the clubface. This effect is most noticeable on the lower lofted clubs. In general, if the golfer sees more loft, he will feel the club is easier to hit and he will be more relaxed and poised for a better swing.

Another exemplary iron golf club in accordance with the present invention is shown generally at 70 in FIG. 5. The club head 70 represents a no. 2 iron which is basically the same as club head 10 except that the weight, the blade loft angle, and the club head shape are designed in accordance with limitations necessary to provide a no. 2 iron as opposed to a no. 8 iron. The club head 70 include hosel 72 which is integrally connected to the head body 74. The head body 74 includes toe portion 76 and heel portion 78. The toe outer edge 80 is slanted at an angle represented by dotted line 82 which is approximately 67 degrees relative to the playing surface 84. Again, the playing surface 84 is assumed to be a flat, horizontal plane with the angle between line 82 and the playing surface being measured when the club head 70 is positioned by the golfer behind the golf ball at the start of the golf swing. It is preferred that as the number of the iron decreases, the angle between the outer edge and the playing surface increases. In the preferred embodiments, the angle increases from 65 degrees for an 8 iron up to 67 degrees for a 2 iron. The slant angles of the cue lines for the numbered irons between the 8 and 2 irons are increased proportionally.

The club head 70 includes cue lines 86 and 88. The cue lines 86 and 88 are required in accordance with the present invention to be substantially parallel to the outer edge 80 to thereby provide at least three substantially parallel visual cues which visually direct the golfer to swing the club head in the manner as previously shown in FIG. 4.

Having thus described exemplary embodiment for the present invention, it should be noted by those skilled in the art that the within disclosures are exemplary only, and that various other alternatives, adaptations and modifications may be made within the scope of the present invention. Thus, by way of example and not of limitation, the disclosed three-line visual cue system, in accordance with the present invention, may also be applied to wood-type clubs in order to promote an inside-outside forward swing. Accordingly, the present invention is not limited to the specific embodiments as illustrated herein, but is only limited by the following claims.

What is claimed is:

1. A golf club head adapted to provide a visual cue to a golfer which promotes an inside-outside forward swing of the club head by the golfer when the club head is positioned on a playing surface, said club head comprising:

a club head body having a heel portion, a toe portion, a front face, a bottom and a top edge, said toe portion having an outer edge which slants towards the golfer when said club head body bottom is positioned on said playing surface, said front face including a plurality of spaced horizontal face lines which are visible to the golfer and substantially horizontal when said club head body is positioned on said playing surface and wherein each of said face lines includes a toe end and a heel end, said face lines being of selected lengths and positioned on said front face to provide a face line toe edge defined by said face line toe ends which is substantially parallel to the outer edge of said toe portion, said selected lengths and positioning of said face lines further providing a face line heel edge defined by said face line heel ends which is substantially parallel to the outer edge of said toe portion and said face line toe edge, wherein the combination of said toe portion outer edge, said face line toe edge and said face line heel edge provides a visual cue to said golfer which promotes said inside-outside swing; and a hosel having a shaft portion including means for connection to a golf club shaft and a club body portion which is integrally connected to said club head body heel portion.

2. A golf club head according to claim 1 further including a slanted cue line extending along said face line toe edge and a slanted cue line extending along said face line heel edge, said cue lines being provided to enhance the visual cue provided by said club head body.

3. A golf club head according to claim 1 wherein the angle between said face line toe edge and said playing surface, when said club head is positioned on said playing surface is between about 60 degrees and 80 degrees.

4. A golf club head according to claim 3 wherein said angle is between 60 degrees and 70 degrees.

5. A golf club head according to claim 1 including a rear face wherein said club head body is shaped so that the top edge of the club head body is visible and said rear face is not visible to the golfer when the club is positioned on the playing surface.

6. A set of numbered golf club heads including numbers 2–9 in which each club head is a club head according to claim 1 wherein the angle between said face line toe edge and said playing surface increases as the club head number decreases.

7. A golf club head according to claim 1 further including a golf shaft connected to said hosel shaft portion.

8. A golf club head according to claim 1 wherein said club head is an iron.

9. A gold club head according to claim 1 wherein it is desired that during the backswing of the club head, the club head moves toward the golfer at a selected backswing angle relative to the desired line of flight of the golf ball, wherein said toe portion outer edge is slanted towards said golfer at a sufficient angle so that said toe portion outer edge is parallel with said backswing angle when viewed by said golfer at the start of the backswing.

10. In a golf club head having a clubhead body and hosel portion, said club head body including a heel portion, a toe portion and a front face, said toe portion having an outer edge, wherein the improvement comprises providing at least three complementary visual cues which promote an inside-outside forward swing, said visual cues including:

an outer edge on said toe portion which slants toward the golfer when the club head is positioned on the playing surface, said outer edge providing a visual cue line which points in the direction of an outside-inside back swing; and a plurality of spaced horizontal face lines on the club head front face which are visible to the golfer and substantially horizontal when said clubhead body is positioned on said playing surface and wherein each of said face lines includes a toe end and a heel end, said face lines being of selected lengths and positioned on said front face to provide a face line toe edge defined by said face line toe ends which is substantially parallel to the outer edge of said toe portion, said selected lengths and positioning of said face lines further providing a face line heel edge defined by said face line heel ends which is substantially parallel to the outer edge of said toe portion and said face line toe edge, wherein the combination of said toe portion outer edge, said face line toe edge and said face line heel edge provides three complementary visual cues to the golfer which promotes an outside-inside backswing and an inside-outside forward swing.

11. A golf club head according to claim 1 wherein said toe portion includes a bottom toe edge which is visible to the golfer as he addresses the golf ball and which meets the front edge of the club head body bottom at a right angle, said toe edge providing a means for the golfer to line the club head up with the golf ball prior to initiating the golf swing.

12. A golf club head according to claim 1 wherein said top edge includes a front line and a rear line and wherein said front and rear lines coverge towards each other from said toe portion towards said heel portion.

* * * * *